US007410150B1

(12) United States Patent
Falls

(10) Patent No.: US 7,410,150 B1
(45) Date of Patent: Aug. 12, 2008

(54) WINCH SAFETY SWITCH FOR A HOIST

(75) Inventor: John W. Falls, Lakeland, TN (US)

(73) Assignee: Aladdin Light Lift, Inc., Memphis, TN (US)

( * ) Notice: Subject to any disclaimer, the term of this patent is extended or adjusted under 35 U.S.C. 154(b) by 0 days.

(21) Appl. No.: 11/981,012

(22) Filed: Oct. 30, 2007

(51) Int. Cl.
*B66D 1/50* (2006.01)

(52) U.S. Cl. ..... 254/272; 254/273; 262/405; 262/148; 262/287; 248/329

(58) Field of Classification Search ..... 254/270–273; 362/405, 147, 148, 150, 284, 285, 287; 248/329
See application file for complete search history.

(56) References Cited

U.S. PATENT DOCUMENTS 2,351,997 A 6/1944 Morrill
2,609,170 A 9/1952 Farrington et al.
3,610,584 A 10/1971 Pfaff, Jr.
4,195,332 A 3/1980 Thompson
4,276,500 A 6/1981 Sumka et al.
4,316,238 A 2/1982 Booty et al.
4,381,539 A 4/1983 Sakurai
4,624,450 A * 11/1986 Christison ..... 254/273
5,105,349 A 4/1992 Falls et al.
5,361,565 A * 11/1994 Bayer ..... 254/292
6,299,139 B1 * 10/2001 Kazerooni ..... 254/270
6,886,812 B2 * 5/2005 Kazerooni ..... 254/270
7,090,200 B2 * 8/2006 Morse et al. ..... 254/332
7,222,839 B2 * 5/2007 Taylor et al. ..... 254/270

OTHER PUBLICATIONS

Benjamin, Announcing Benjamin "SAFLOX" Floodlight Lowering Attachment, Advertisement Schedule 17 (Mar. 11, 1938) pp. F4A-5 through F4A-8, U.S.A.
Omron Corporation, General Purpose Basic Switch Z-15HNJS55-B, Specification No. 0793531-0A1 and Drawing No. 2300135-1B2 (Nov. 30, 2005) 9 pages, Japan.

* cited by examiner

*Primary Examiner*—Emmanual M Marcelo
(74) *Attorney, Agent, or Firm*—Walker, McKenzie & Walker, P.C.

(57) ABSTRACT

An improved hoist for raising and lowering a weighted object secured to a hoist cable, wherein the improvement comprises a safety switch in series with an up-down switch of the hoist. The safety switch has an actuating member with spaced-apart first and second portions on either side of the hoist cable and proximate the take-up shaft of the winch, and, when the hoist cable becomes unweighted or becomes wound upon the take-up shaft in an improper direction, the hoist cable moves the actuating member and prevents the up-down switch from applying power to the winch motor, thereby disabling the winch motor.

4 Claims, 10 Drawing Sheets

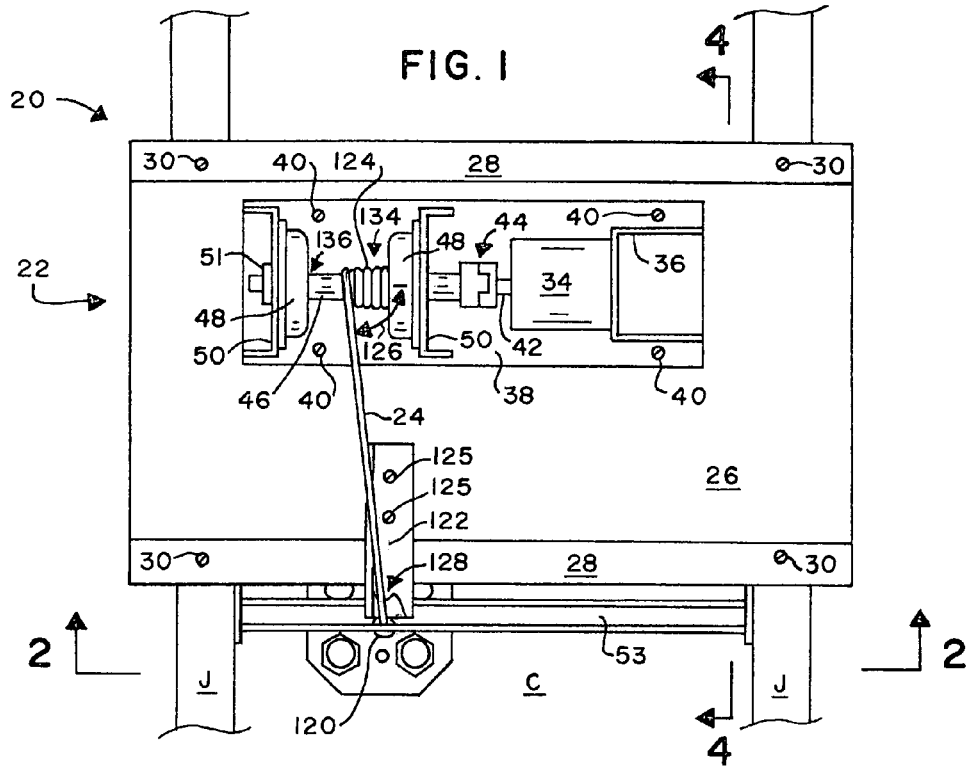
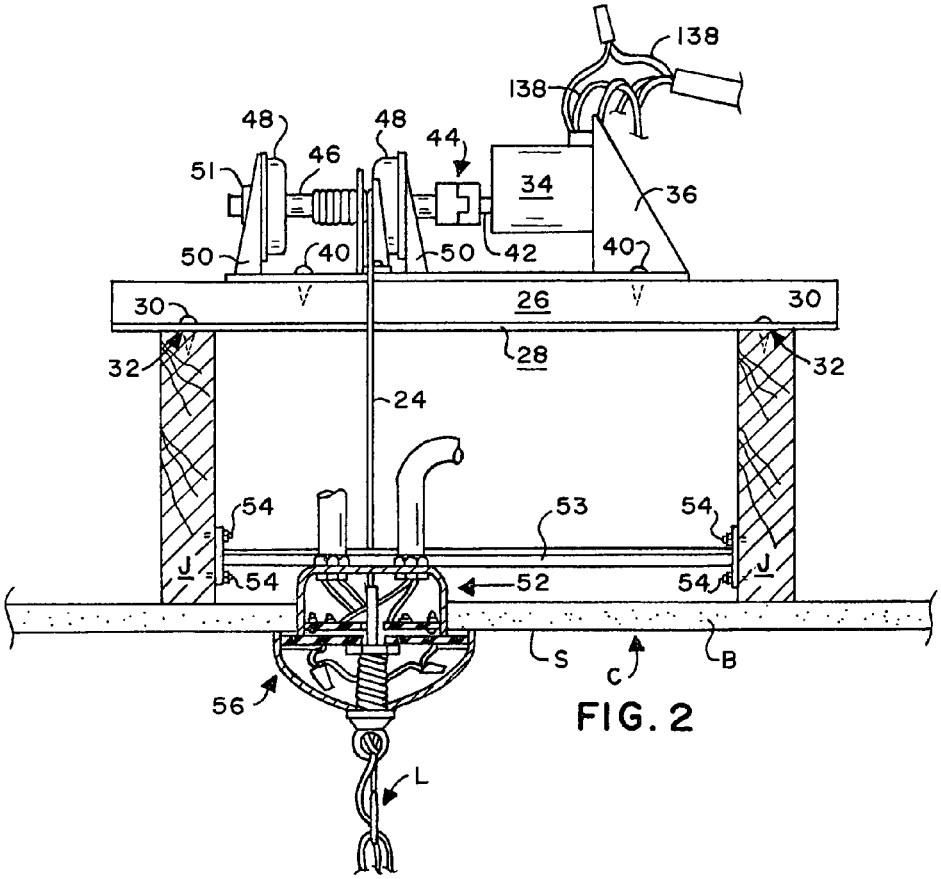
FIG. 2

WINCH SAFETY SWITCH FOR A HOIST

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to winches and hoists, and in particular, to hoists having motorized winches and safety devices therefor.

2. Information Disclosure Statement

This application is a safety improvement that may be used with hoists having motorized winches such as, for example, the hoist disclosed in U.S. Pat. No. 5,105,349 (issued Apr. 14, 1992).

It is often desired to provide a hoist with a motorized winch to raise and lower objects. A typical and well-known hoist is disclosed in U.S. Pat. No. 5,105,349 (issued Apr. 14, 1992) for raising and lowering a chandelier to and from a ceiling in a home or other building, and such a motorized winch typically has a spool or reel on which a hoist cable is wound and unwound to raise and lower an object such as a chandelier.

Two problems are sometimes seen with such winches and hoists. First, sometimes the winch of the hoist is improperly operated when the weighted object (e.g., the chandelier) is not pulling downwardly on the hoist cable. This "unweighted" problem condition may be seen, for example, if a piece of furniture, such as a table, happens to be below the chandelier and an inattentive operator keeps lowering the chandelier until it hits the piece of furniture or even the floor, and, occasionally, a very inattentive operator may keep the winch in a lowering mode past the point when the chandelier hits the piece of furniture or the floor. A similar "unweighted" situation develops if an operator tries to operate the winch when the object's weight is removed, as when the chandelier is removed from the hoist cable. When the winch is operated while in this "unweighted" condition, the hoist cable tends to become tangled and may come off of the winch's spool or reel.

A second problem occurs when an inattentive operator allows the winch to be operated past the point when the hoist cable become fully unwound from the winch spool or reel, such that the winch, still turning in the "unwinding" direction, begins winding the cable back on to the spool or reel in the reverse direction, hoisting the object (e.g., a chandelier) while the winch is still turning in the "unwinding" direction. Some winches have safety cutoff switches that will stop the operation of the winch motor when the hoisted object reaches an upper limit, but some such safety cutoff switches are designed to only operate when the winch is in the "raising" mode, such that the winch spool or reel is turning in the "winding" direction. Because this second problem causes the hoist cable to be improperly wound on the winch spool or reel in the reverse direction, often the safety cut-off switches are ineffective (because the winch is turning in the "unwinding" direction yet the hoist cable is being wound onto the winch spool or reel), and the safety cutoff switch does not stop the operation of the winch when the hoisted object attempts to travel past its upper limit. Such a failure can cause, for example, a chandelier to be hoisted through the ceiling, causing damage, and has been known to cause the hoist cable to break and the chandelier to fall, causing injury and property damage, especially if the winch motor is improperly fused or if the fuse or circuit breaker on the winch has been disabled.

It is therefore desirable to provide a winch safety switch for a hoist such that the winch safety switch disables the operation of the winch motor if the winch is operated in its unwinding/lowering mode when either the hoist cable becomes unweighted or if the winch begins winding the hoist cable in the reverse direction after passing the fully-unwound point.

A preliminary patentability search in class 362, subclasses 147, 384, 404, 391, 418, and 403, for the invention disclosed in U.S. Pat. No. 5,105,349, produced the following patents, some of which may be relevant to the present invention: Farrington et al., U.S. Pat. No. 2,609,170, issued Sep. 2, 1952; Pfaff, U.S. Pat. No. 3,610,584, issued Oct. 5, 1971; Booty et al., U.S. Pat. No. 4,316,238, issued Feb. 16, 1982; and Sakurai, U.S. Pat. No. 4,381,539, issued Apr. 26, 1983. Additionally, during prosecution of the predecessor of the application that issued as U.S. Pat. No. 5,105,349, an advertisement of a floodlight lowering attachment, dated Mar. 11, 1938, manufactured and sold by the Benjamin Company under the name "SAFLOX", was cited by the Examiner.

Farrington et al., U.S. Pat. No. 2,609,170, describes a motor-driven lamp hanger with multiple embodiments. The Farrington device, as described, has four cables supporting the lamp fixture which are wound on four separate drums. The Farrington patent also describes upper and lower limit switches to shut off the power to the drive motor at the extremes of travel of the lamp fixture, as well as fixed and mating contacts to supply power to the lamp fixture when in the raised position.

Pfaff, U.S. Pat. No. 3,610,584, describes a lowering mechanism for a light fixture which comprises a drive motor and braking mechanism, said drive motor being coupled through a chain drive mechanism to a take-up shaft comprising a pair of drums, each of which winds a flexible ribbon or tape which is attached to the light fixture.

Booty et al., U.S. Pat. No. 4,316,238, describes a light fixture and elevator therefor, comprising a horizontally reciprocal carriage, a biasing spring attached to the carriage, said carriage moving horizontally as the light fixture is raised and lowered. A hydraulic piston may be attached to the carriage of the Booty device for controlling the rate of movement of the carriage, and therefore the descent rate of the light fixture. The Booty device is manually operated and is not motorized, and has no contacts which interrupt the flow of electricity to the light fixture when the light fixture is not in the raised position.

Sakurai, U.S. Pat. No. 4,381,539, describes a manually-operated non-motorized height level adjusting means for a light fixture comprising a string winder with ratchets which winds a plural number of strings or wires, attached to the light fixture, onto a plural number of spools. Also, the Sakurai patent, like the Booty device, has no contacts which interrupt the flow of electricity to the light fixture when the light fixture is not in the raised position.

The advertisement for the Benjamin "SAFLOX" floodlight lowering attachment shows a hand operated non-motorized mechanism that raises and lowers an outdoor floodlight. The mechanism includes two sets of contacts that meet and are protected when the lamp is in the raised position.

None of these references, either singly or in combination, disclose or suggest the present invention.

BRIEF SUMMARY OF THE INVENTION

The present invention is an improved hoist for raising and lowering a weighted object secured to a hoist cable. The hoist includes a motorized winch driven by a reversible motor, and the winch includes a take-up shaft upon which the hoist cable is wound and unwound. An up-down switch selectively applies power to the reversible motor and causes the motor to turn the take-up shaft in a raising direction or in a lowering direction so as to wind and unwind the hoist cable upon the take-up shaft. The improvement of the present invention is a safety switch in series with the up-down switch such that, when the safety switch is actuated, power cannot be applied to the motor by the up-down switch. The safety switch is preferably a modified so-called "whisker switch" that has an actuating member, preferably a closed loop, that has first and second spaced-apart portions on opposite sides of the hoist cable proximate the take-up shaft, such that the safety switch is actuated when the hoist cable contacts the first or second spaced-apart portions of the actuating member, thereby causing the actuating member to be moved into one of a plurality of actuated positions.

It is an object of the present invention to provide an improved hoist having a motorized winch whereby the winch is disabled when the hoist cable becomes unweighted. It is a further object of the present invention that the winch become disabled if the hoist cable becomes wound in a reversed direction upon the take-up shaft of the winch, as might happen if the winch keeps turning past the point where the hoist cable is fully unwound.

BRIEF DESCRIPTION OF THE SEVERAL VIEWS OF THE DRAWING

FIG. 1 is a top plan view of the first embodiment of the present invention, shown mounted on top of a pair of ceiling joists.

FIG. 2 is a front elevational view of the first embodiment, taken substantially along the lines 2-2 shown in FIG. 1.

DETAILED DESCRIPTION OF THE INVENTION

Referring to FIGS. 25-28 of the drawings, the present invention is an improved hoist 500 for raising and lowering a weighted object W secured to a hoist cable 502. Several prior art hoist embodiments are shown in FIGS. 1-23 for raising and lowering a weighted object such as a chandelier, and these embodiments will first be described in detail so that a better understanding may be provided of prior art hoists and so that the improvement of the present invention may be better appreciated. Following the disclosure of these prior art hoists, the improvement of the present invention will be discussed in detail.

Figure 3:
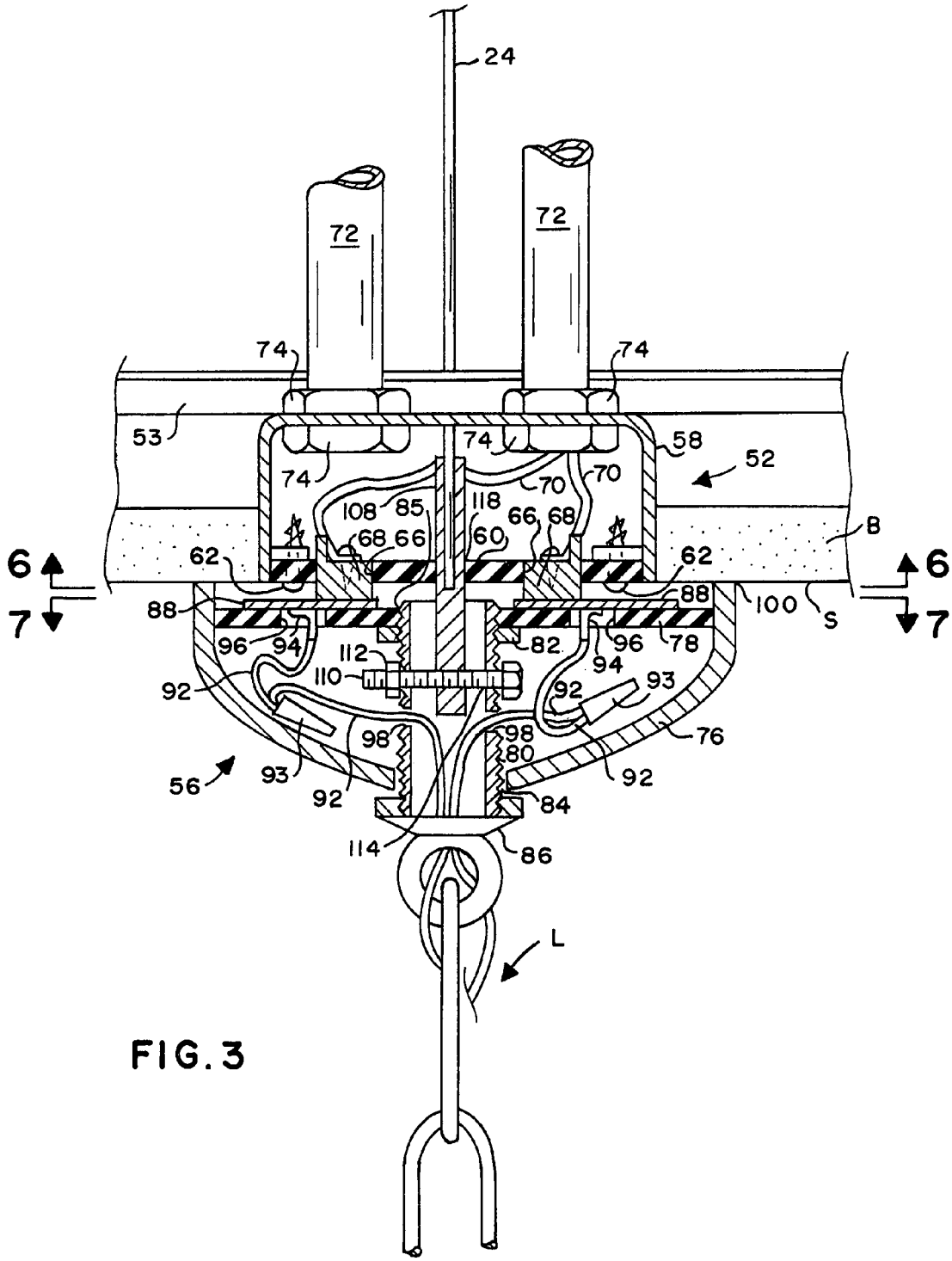
FIG. 3 is a detail of a portion of FIG. 2, showing the ceiling junction box and canopy junction box of the first embodiment.

Referring to FIG. 1, a first embodiment of a prior art motorized light fixture lift system 20 is seen to comprise a hoist mechanism 22 for raising and lowering a chandelier or ceiling light fixture L, partially shown in FIGS. 2 and 3, and a single hoist wire or cable 24. Hoist mechanism 22 is seen to include a base 26 for mounting above a ceiling C. Base 26, preferably constructed from sheet metal, may include mounting flanges 28 for attachment to spaced apart ceiling joists J such as by nails or screws 30, passing through holes or slots 32, shown in FIGS. 2 and 4, in flanges 28. Additional holes or slots, not shown, may be provided in mounting flanges 28 for accommodating the various joist spacings that may be typically encountered, and base 26 is preferably oversized so as to easily span the larger joist spacings as required.

Figure 4:
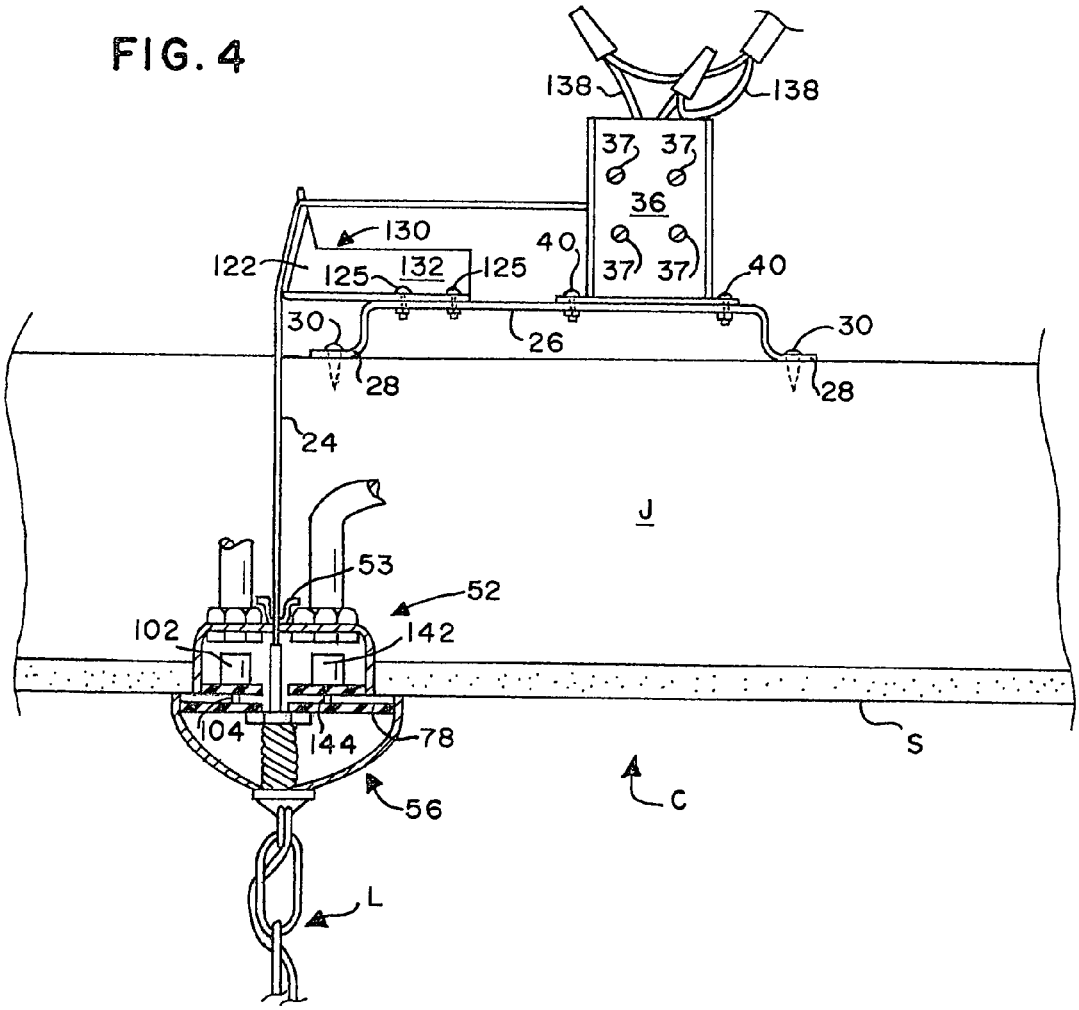
FIG. 4 is a right side elevational view of the first embodiment, taken substantially along the lines 4-4 shown in FIG. 1.

Hoist mechanism 22 also is seen to include a drive motor 34, preferably a reversible synchronous drive motor as shown, mounted upon base 26, preferably using screws 37, shown in FIG. 4, securing drive motor 34 to mounting bracket 36 attached to mounting plate 38 of base 26. Mounting plate 38 may be welded to base 26 or attached by other means such as screws 40 as shown. Drive motor 34 includes a drive shaft 42 directly coupled through a coupling 44, preferably a flexible coupling and spider as shown in FIG. 1, well known to those skilled in the art, to take-up shaft 46. Take-up shaft 46 is supported by bearings 48, preferably self-aligning bronze bearings, mounted upon support brackets 50, which may be made of sheet metal, and may be secured by shaft collar 51 as shown.

Referring to FIGS. 1, 2, 3, and 4, lift system 20 also is seen to comprise a ceiling junction box 52, mounted a fixed distance from base 26, preferably mounted substantially flush with lower ceiling surface S of ceiling tile or gypsum board B attached to joists J. Ceiling junction box 52 is typically mounted to the ceiling using a "U"-shaped support bracket 53, well known to those skilled in the art, attached to joists J using nails or screws 54 and spanning the distance between joists J as shown. Lift system 20 is also seen to include a canopy junction box 56, shown in FIGS. 2, 3, and 4, attached to light fixture L.

Referring to FIG. 3, the details of ceiling junction box 52 and canopy junction box 56 can be seen. Ceiling junction box 52 includes a body 58, preferably a well known electrical junction box as shown, and a ceiling junction box cover plate 60, secured to body 58 by screws 62 passing through holes 64 (shown in FIG. 6). Cover plate 60, constructed of a suitably strong non-conductor material, includes holes 66 in which are mounted a first set of contacts 68 for supplying a source of electrical power, through wires 70 connected to a usual power source, not shown. Wires 70 may be attached to contacts 68 using screw terminals or clips, well known to those skilled in the art. Typically, wires 70 will pass through conduit 72 anchored to ceiling junction box 52 using nuts 74.

Canopy junction box 56 is seen to preferably comprise a canopy cover 76, canopy junction box cover plate 78, and threaded sleeve 80. In the preferred first embodiment, cover plate 78 has a hex nut 82 securely attached to the underside thereof, securing cover plate 78 to threaded sleeve 80, which passes through hole 84 in canopy cover 76 and is then secured to canopy cover 76 by threaded hanger 86, which supports lighting fixture L, partially shown. Cover plate 78 is seen to have a hole 85 in substantial alignment with hex nut 82, providing clearance for sleeve 80. Cover plate 78, constructed of a suitably strong non-conductor material, has a second set of contacts, preferably semi-circular plates 88 also shown in FIG. 7, laminated to the upper surface thereof as shown, mounted for receipt of electricity from the first set of contacts when the light fixture is in the raised position, adjacent the ceiling. Together, the first set and second set of contacts, 68 and 88, are seen to comprise contact means for supplying electrical power to the light fixture when the light fixture is in the raised position. The spacing 90 between plates 88 is preferably greater than the width of first set of contacts 68 so that plates 88 are not susceptible to being shorted together by first set of contacts 68 for certain orientations of canopy junction box 56 with respect to ceiling junction box 52, as will now be apparent. Wires 92, possibly joined by wire nuts 93, attach to plates 88 preferably by means of terminals or clips 94 which pass through holes 96 in cover plate 78. Wires 92 also pass through holes 98 in threaded sleeve 80 and through a hole, not shown, in threaded hanger 86, and attach to lamps, not shown, in light fixture L, in the usual manner. Preferably, either or both of first set of contacts 68 or second set of contacts 88 are magnetized for attraction to each other when the light fixture is in the raised position, adjacent the ceiling, to ensure secure and positive connection between the two sets of contacts.

In the preferred first embodiment, shown in FIG. 3, means are provided, such as peripheral edge 100 of canopy cover 76, extending toward ceiling surface S, for covering contact means, such as first and second set of contacts 68 and 88, from substantial access when the light fixture is in the raised position as shown in FIG. 3, as now understood by those skilled in the art.

Referring to FIG. 4, ceiling junction box 52 may additionally comprise safety switch means, preferably such as normally open plunger type switch 102, wired in series, in a manner well known to those skilled in the art, between first set of contacts 68 and the source of electrical power, not shown, which supplies electricity to contacts 68. Plunger switch 102 is positioned with actuating plunger 104 extending downwardly through hole 106 in ceiling junction box cover plate 60, shown in FIG. 6, in a manner so that, as light fixture L enters the raised position, plunger 104 is urged upwardly, closing the circuit within plunger switch 102 and thereby connecting first set of contacts 68 to the source of electrical power, in a manner well known to those skilled in the art. Conversely, as light fixture L leaves the raised position, the flow of electricity from the source of electrical power to first set of contacts 68 is interrupted as plunger switch 102 assumes the normally open condition when plunger 104 is allowed to proceed downwardly, in a manner now apparent to those skilled in the art. In this manner, when light fixture L is not in the raised position, and contacts 68 are exposed for access, electrical power is removed from contacts 68, providing greater safety to a maintenance worker. Obviously, other appropriate safety switch means could be similarly provided to remove power from contacts 68 when they are exposed for access, in a manner that will now be apparent to those skilled in the art.

Figure 9:
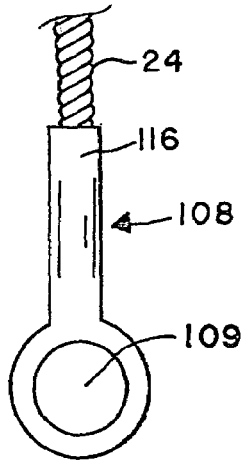
FIG. 9 is a view of the end of the first embodiment hoist cable, showing the attachment of the anchor.

Referring to FIG. 3, hoist cable 24 is seen to allow raising and lowering of light fixture L, preferably by attachment to canopy junction box 56 by attachment means such as anchor 108, shown from another view in FIG. 9, secured to threaded sleeve 80 by securing means such as a cotter pin or preferably a nut 112 and bolt 110 inserted through hole 114 drilled transversely through threaded sleeve 80, and also inserted through opening 109 formed within anchor 108. Hoist cable 24 is securely fastened to anchor 108 by means well known to those skilled in the art, such as by being crimped within a sleeve of anchor 108 or preferably by being welded to or within a sleeve portion 116 of anchor 108.

Figure 5:
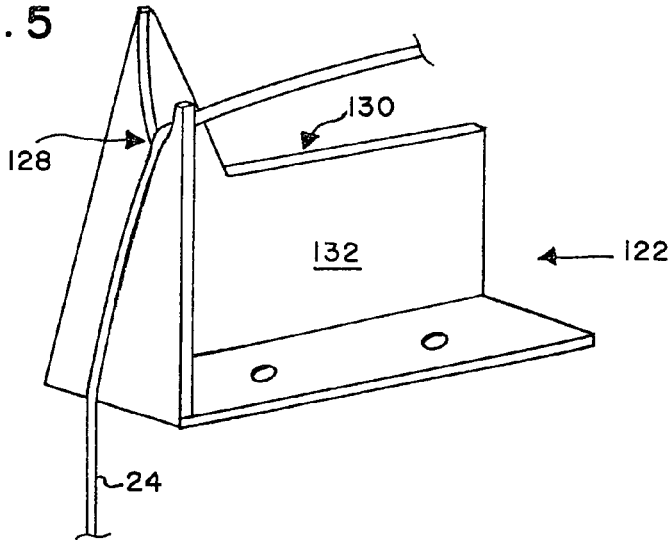
FIG. 5 is a perspective view of the cable guide of the first embodiment.
Figure 6:
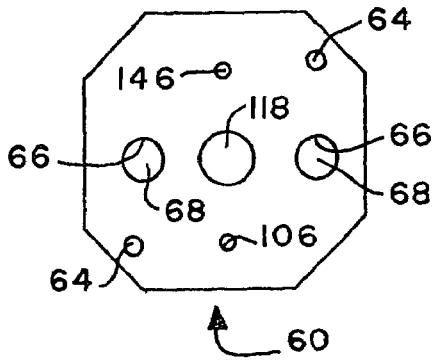
FIG. 6 is a bottom view, looking upward, of the ceiling junction box cover plate of the first embodiment, taken substantially along the lines 6-6 shown in FIG. 3.
Figure 7:
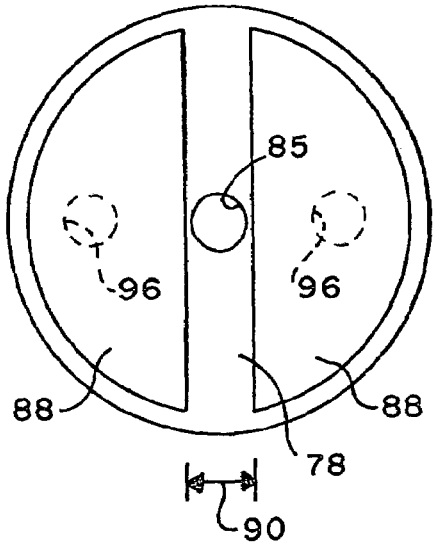
FIG. 7 is a top view, looking downward, of the canopy junction box cover plate of the first embodiment, taken substantially along the lines 7-7 shown in FIG. 3.

Hoist cable 24 and anchor 108 are seen to pass through hole 118 of ceiling junction box cover plate 60, with hoist cable 24 continuing to pass through hole 120 in ceiling junction box 52, between joists J, then, guided by cable guide 122, passing to take-up shaft 46 of hoist mechanism 22, where it is secured for winding into windings 124 which are constrained, such as by bearings 48, to lie within the region of take-up shaft 46 defined by portion 134 of take-up shaft 46, toward motor 34, and that defined by portion 136 of take-up shaft 46, remote from motor 34. Referring to FIG. 1, cable guide 122, preferably attached to base 26 using means well known to those skilled in the art, such as screws 125, applies tension to hoist cable 24 as it winds onto take-up shaft 46, urging windings 124 to be biased toward one end of shaft 46 by preferably guiding hoist cable 24 at an angle 126, preferably not more than ninety degrees, with respect to take-up shaft 46. In the first embodiment of the prior art hoist, as shown in FIG. 5, cable guide 122 has a notch 128, preferably "U" shaped as shown, for receiving hoist cable 24, as well as a cutaway portion 130 in flange 132 for avoidance of hoist cable 24. If desired, a pulley (not shown) may be provided on cable guide 122, in a manner well known to those skilled in the art, to reduce the frictional forces that might be present where notch 128 receives hoist cable 24; this pulley would perform substantially the same function as notch 128, with less friction upon cable 24. It will be apparent to those skilled in the art that in order for angle 126 to be not more than ninety degrees, as desired for this first embodiment of the prior art hoist, notch 128 shown in FIG. 1 should be located outside, or on the boundary of, the region defined at one end by a first extended radius of shaft 46 at portion 134 thereof, and at the other end by a second extended radius of shaft 46 at portion 136 thereof (i.e., the extremes of the available winding area on shaft 46). When notch 128 is so located, cable guide 122, guiding hoist cable 24 at angle 126 with respect to take-up shaft 46, urges windings 124 to be biased toward one end of take-up shaft 46. Were angle 126 to be greater than ninety degrees, as if, for instance, were cable guide 122 to be positioned midway between the first and second extended radii described above, windings 124 of hoist cable 24 would not be urged toward one end of take-up shaft 46 as they are using the preferred orientation, since angle 126 would range from less than ninety degrees to greater than ninety degrees as cable 24 winds onto take-up shaft 46. As hoist cable 24 winds and unwinds on take-up shaft 46, light fixture L is raised and lowered, traveling from a raised position adjacent ceiling C, as shown in FIGS. 2 through 4, to a lowered position, not shown, distant from the ceiling, for cleaning, maintenance, and changing of bulbs.

It should be understood that an existing ceiling junction box may be adapted for use with this prior art hoist, as ceiling junction box cover plate 60 is preferably sized for attachment to such a standard ceiling junction box, and that a commercially available canopy cover (and threaded sleeve therein), which typically may be used with a lighting fixture, may be adapted and re-worked in accordance with this specification and FIG. 3, by drilling holes 114 and 98 within sleeve 80, thus saving cost to the installer of the motorized chandelier lift system.

Figure 8:
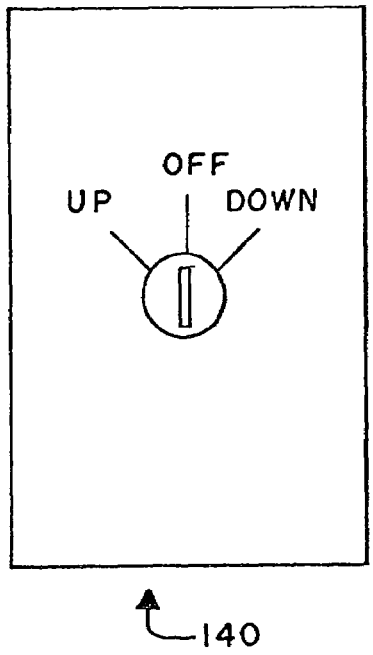
FIG. 8 is a view of the wall box key switch which controls the present invention.

Motor 34 is supplied power through wires 138 attached to a power source, not shown, and is wired, in a manner well known to those skilled in the art, to a control switch, such as wall box key switch 140, shown in FIG. 8. Key switch 140 preferably has three positions, up, off, and down, which cause motor 34 to wind and unwind cable 24 as desired. In the preferred first embodiment, the lift system also comprises limit means which interrupt the flow of power to the drive motor as the light fixture enters the raised position, preventing damage to the lift system, ceiling, or light fixture that might occur were an attempt made to raise the light fixture past the raised position, such as normally closed plunger type limit switch 142, interposed between drive motor 34 and its power source and wired in a manner well known to those skilled in the art. Limit switch 142, shown in FIG. 4, is positioned for interruption of the flow of power to the drive motor as the light fixture enters the raised position, preferably with actuating plunger 144 of limit switch 142 extending downwardly through hole 146 in ceiling junction box cover plate 60, shown in FIG. 6, for contact with canopy junction box cover plate 78 as light fixture L enters the raised position, urging plunger 144 upwardly, opening the circuit within limit switch 142, and thus interrupting power to drive motor 34. It should be understood that alignment marks (not shown) may be provided on canopy cover 76 and ceiling surface S to indicate when contacts 68 are in optimal rotational alignment with plates 88, allowing light fixture L to be rotated, if necessary, for proper mating between contacts 68 and plates 88.

In practice, a maintenance worker would operate wall box key switch 140, causing motor 34 to lower light fixture L for maintenance. As light fixture L leaves the raised position, plunger switch 102 removes power from first set of contacts 68 as they become exposed for access, the light fixture descends further to a lowered position distant from the ceiling, allowing maintenance, and the key switch is returned to the "off" position. After maintenance is completed, key switch 140 is placed in the "up" position, causing motor 34 to raise light fixture L toward the ceiling. As light fixture L enters the raised position, plunger switch 102 is actuated, restoring power to first set of contacts 68, which are magnetically attracted to the second set of contacts, such as plates 88, restoring electricity to light fixture L. Also, as light fixture L enters the raised position, limit switch 142 is actuated, interrupting the flow of power to drive motor 34, preventing light fixture L from being raised past the raised position adjacent the ceiling. Light fixture L will remain in the raised position until key switch 140 is again turned to the "down" position, repeating the lowering process.

For adaptability to ceilings of various heights, cable 24 may be provided with excess length, sufficient to lower light fixture L for access. As a part of the installation process, it will be understood that cable 24 may be cut to an appropriate length, preferably extending from hoist mechanism 22 to three feet from the floor, and then attached to take-up shaft 46 in any manner well known to those skilled in the art. Adjustment of cable 24 to such an appropriate length will prevent light fixture L from being damaged by inadvertent contact with the floor, as might otherwise happen if an inattentive maintenance worker left wall box key switch 140 in the "down" position and if cable 24 were excessively long. It will now be apparent that if the length of cable 24 is chosen so that light fixture L cannot inadvertently contact the floor, hoist mechanism 22, after lowering light fixture L to the fully lowered position, will then begin to raise the light fixture back toward the ceiling as take-up shaft 46 continues rotating.

A second embodiment of the prior art motorized light fixture lift system is shown in FIGS. 10-22, with identifying reference designators marked similarly to the first embodiment, except with the prefix "2.".

Figure 10:
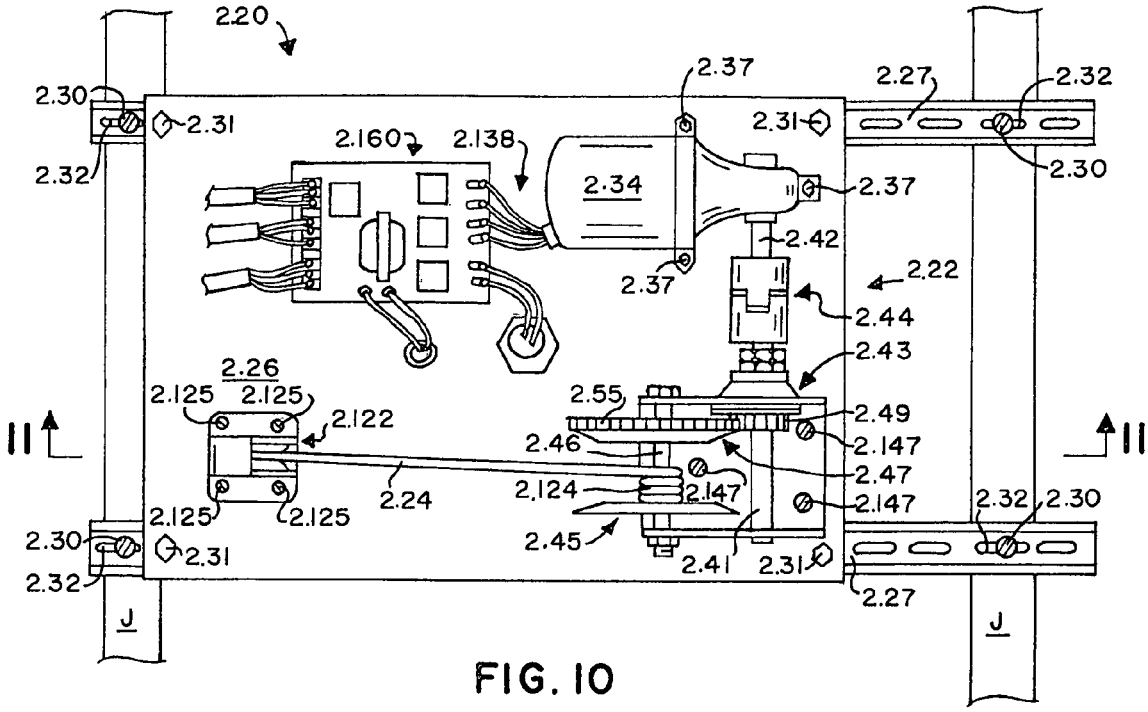
FIG. 10 is a top plan view of the second embodiment of the present invention, shown mounted on top of a pair of ceiling joists.
Figure 11:
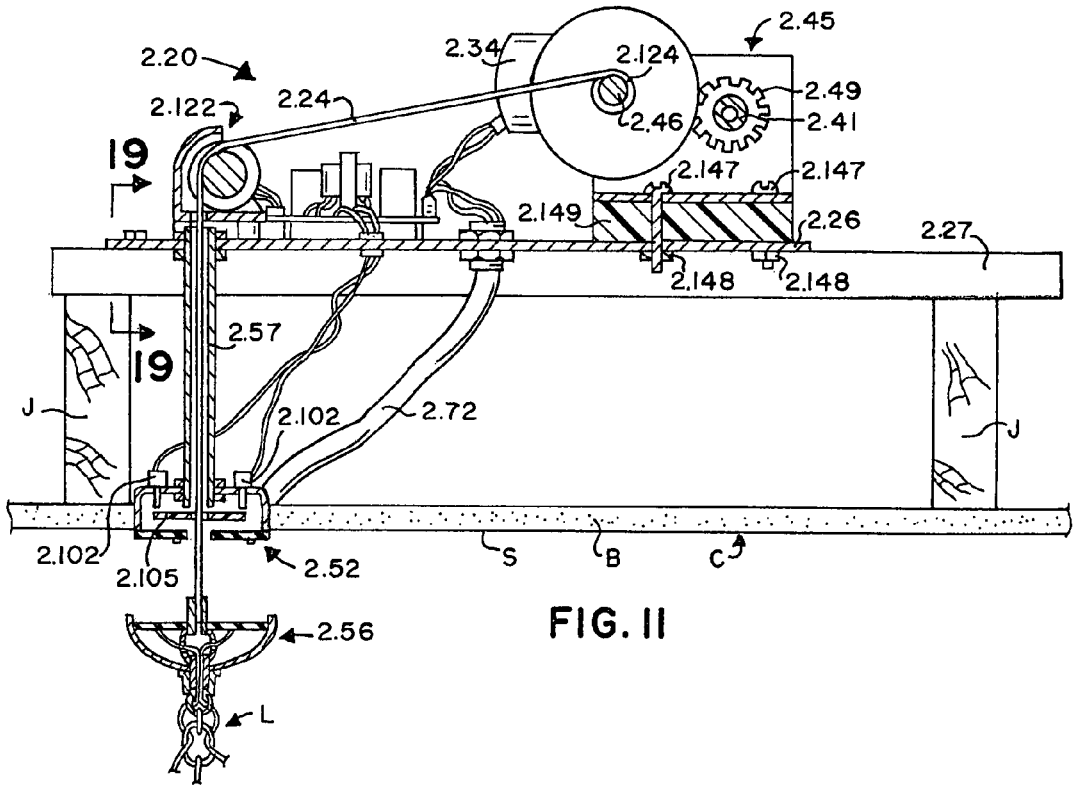
FIG. 11 is a front sectional view of the second embodiment, taken substantially along the lines 11-11 shown in FIG. 10.
Figure 12:
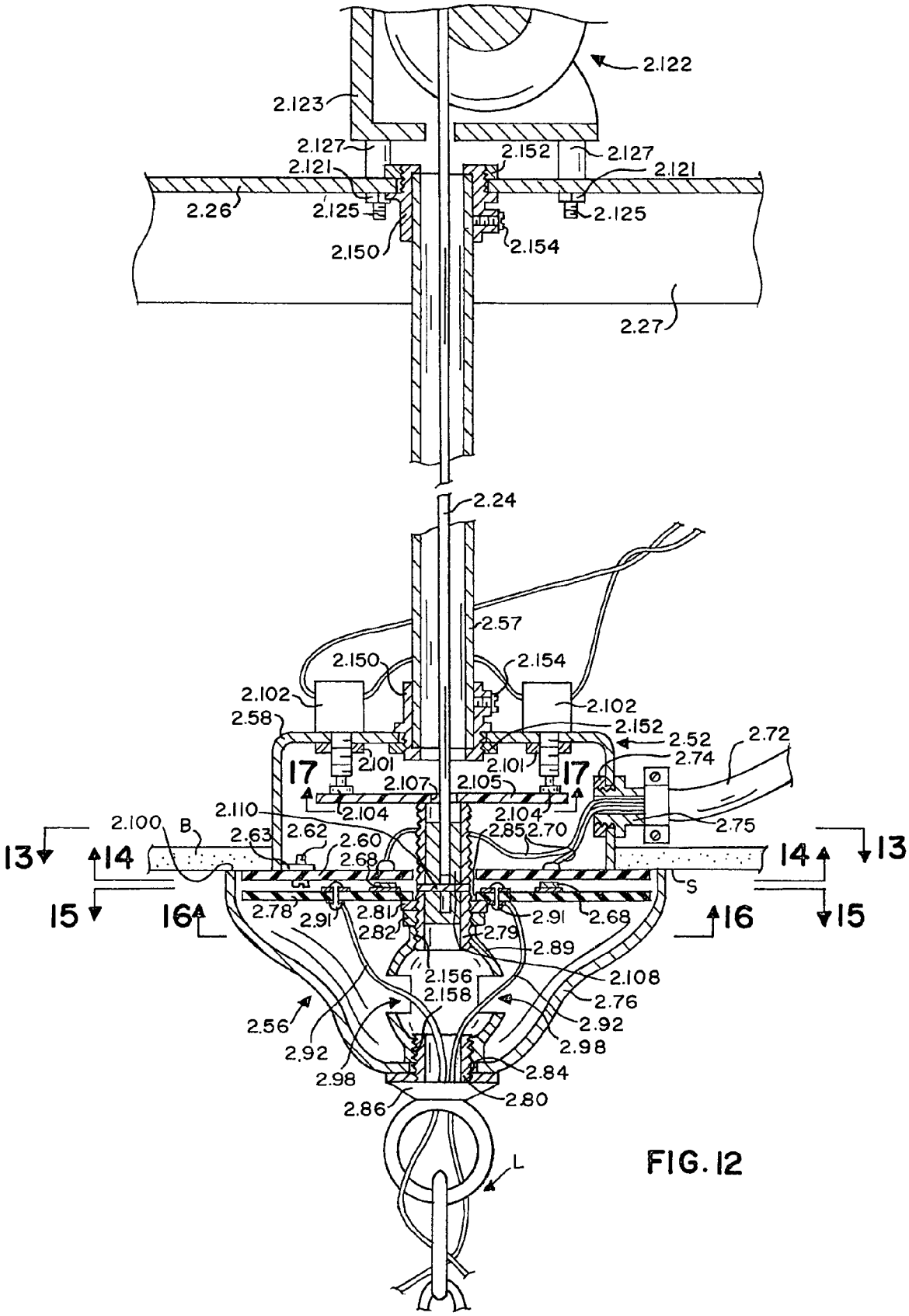
FIG. 12 is a detail of a portion of FIG. 11, showing the canopy junction box as well as the ceiling junction box and its mounting, for the second embodiment.
Figure 13:
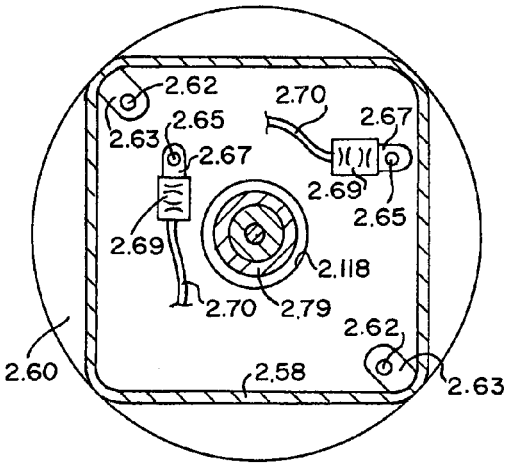
FIG. 13 is a top sectional view of the ceiling junction box of the second embodiment, taken substantially along the lines 13-13 shown in FIG. 12.
Figure 14:
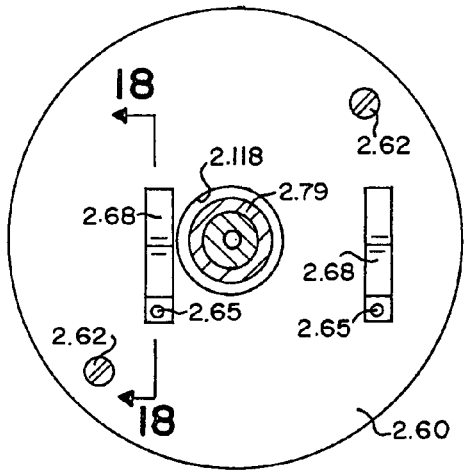
FIG. 14 is a bottom view, looking upward, of the ceiling junction box cover plate of the second embodiment, taken substantially along the lines 14-14 shown in FIG. 12.

Referring to FIG. 10, a second embodiment of the motorized light fixture lift system 2.20 is seen to comprise a hoist mechanism 2.22 for raising and lowering a chandelier or ceiling light fixture L, partially shown in FIGS. 11 and 12, and a single hoist wire or cable 2.24. Hoist mechanism 2.22 is seen to include a base 2.26 for mounting above a ceiling C. Base 2.26, preferably constructed from sheet metal, mounts on rails 2.27 spanning spaced apart ceiling joists J. Rails 2.27 are attached to joists J by securing means such as by nails or screws 2.30, passing through a selected set of holes or slots 2.32 in rails 2.27 and chosen to match the spacing between the joists J. Base 2.26 may be adjustably mounted on rails 2.27 using base positioning means 2.29 shown in FIG. 19, preferably comprising a bolt 2.31, a nut 2.33, and a washer 2.35 adjustably securing base 2.26 to inwardly extending lips 2.25 of rails 2.27 in a manner that will now be apparent, thereby allowing base 2.26 to be positioned between joists J as required.

Hoist mechanism 2.22 also is seen to include a drive motor 2.34, preferably a reversible synchronous drive motor as shown, mounted upon base 2.26, preferably using screws 2.37. In this second preferred embodiment, motor 2.34 may be a right-angle shaft gearmotor, such as the Model V3-65 right-angle shaft gearmotor, manufactured by Von Weis Gear Company, St. Louis, Mo., allowing compact placement of motor 2.34 on base 2.26 as shown in FIG. 10. Drive motor 2.34 includes a drive shaft 2.42 coupled through a coupling 2.44, preferably a flexible coupling and spider as shown in FIG. 10, well known to those skilled in the art, to take-up shaft 2.46. Preferably, take-up shaft 2.46 constitutes part of a winch means 2.45 for winding and unwinding cable 2.24. Winch means 2.45 may have gear means 2.47, comprising gears 2.49 and 2.55, rotatably coupling input shaft 2.41 to take-up shaft 2.46. Preferably, winch means 2.45 also comprises self-activating automatic braking means 2.43, well-known to those skilled in the art, for preventing cable 2.24 from unwinding except as caused by the rotation of drive shaft 2.42. A suitable winch having gears and a self-activating automatic braking means is the Model K1051 winch, manufactured by Fulton Performance Products, P.O. Box 19903, Milwaukee, Wis. 53219. Braking means 2.43 prevents the load, i.e., light fixture L, from falling if, for instance, coupling 2.44 were to become loosened on shaft 2.42 or shaft 2.41. Winch means 2.45 also may mount to base 2.26 using screws 2.147 and nuts 2.148, passing through spacer block 2.149 chosen in thickness to place shafts 2.41 and 2.42 in substantial alignment. It shall be understood, however, that, by appropriate arrangement of parts on base 2.26, drive shaft 2.42 could be coupled to take-up shaft 2.46 as in the first preferred embodiment, without using a right-angle drive gearmotor 2.34, and instead using a motor whose shaft is coaxially aligned with take-up shaft 2.46, omitting gear means 2.47 and shaft 2.41, without departing from the spirit and scope of the second preferred embodiment.

Referring to FIGS. 11-14, lift system 2.20 also is seen to comprise a ceiling junction box 2.52, preferably mounted substantially flush with lower ceiling surface S of ceiling tile or gypsum board B attached to joists J. Ceiling junction box 2.52 is seen to be mounted a fixed distance from base 2.26, attached to one end of a conduit tube 2.57, whose other end is attached to base 2.26. Tube 2.57, attached at either end to base 2.26 and ceiling junction box 2.52 by well-known electrical conduit connectors 2.150, nuts 2.152, and set screws 2.154, see FIG. 12, is selected for a length, when base 2.26 is mounted above joists J on rails 2.27, that will cause ceiling junction box 2.52 to be substantially flush with ceiling surface S. For instance, if joists J are well-known "2×6" beams, tube 2.57 will typically be 5 5/16 inches long. Similarly, if joists J are well-known "2×10" beams, tube 2.57 necessarily will be longer, typically 9 1/16 inches long.

Lift system 2.20 is also seen to include a canopy junction box 2.56, shown in FIGS. 11, 12, 15, and 16, attached to light fixture L.

Referring to FIG. 12, the details of ceiling junction box 2.52 and canopy junction box 2.56 can be seen. Ceiling junction box 2.52 includes a body 2.58, preferably a well known electrical junction box as shown, and a ceiling junction box cover plate 2.60, secured to body 2.58 by screws 2.62 passing through holes in tabs 2.63 (shown in FIGS. 12 and 13). Cover plate 2.60, see FIGS. 12-14 and 18, constructed of a suitably strong non-conductor material, includes screws or rivets 2.65 which attach a first set of contacts 2.68 for supplying a source of electrical power to terminals 2.67, through wires 2.70 connected to a power source, in a manner hereinafter described. Wires 2.70 may be attached to terminals 2.67 using screws or preferably slide-on clip fasteners, well known to those skilled in the art, such as fasteners 2.69. Typically, wires 2.70 will pass through conduit 2.72 which is anchored to ceiling junction box 2.52 using nut 2.74 on feedthrough 2.75.

Figure 15:
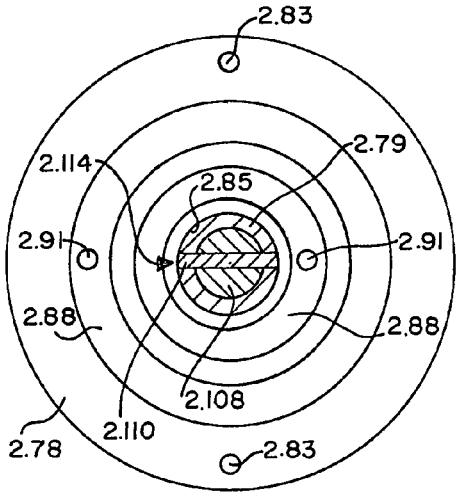
FIG. 15 is a top view, looking downward, of the canopy junction box cover plate of the second embodiment, taken substantially along the lines 15-15 shown in FIG. 12.
Figure 16:
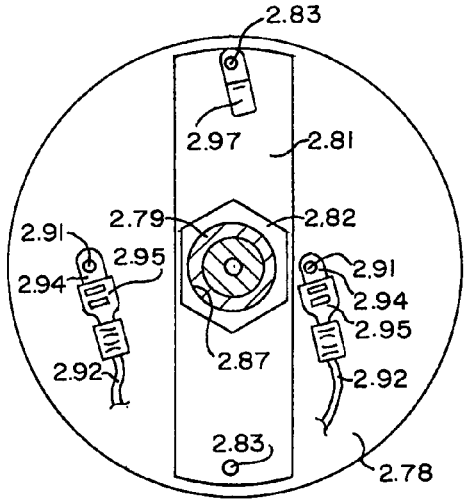
FIG. 16 is a bottom view, looking upward, of the canopy junction box cover plate of the second embodiment, taken substantially along the lines 16-16 shown in FIG. 12.
Figure 17:
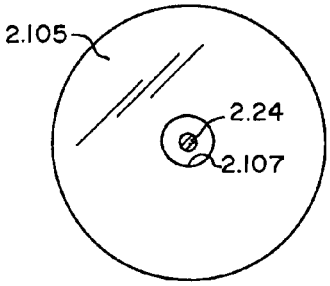
FIG. 17 is a bottom view, looking upward, of the canopy junction box actuating plate of the second embodiment, taken substantially along the lines 17-17 shown in FIG. 12.
Figure 18:
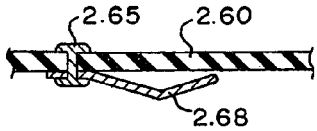
FIG. 18 is a sectional view of a contact on the ceiling junction box cover plate of the second embodiment, taken substantially along the lines 18-18 shown in FIG. 14.
Figure 19:
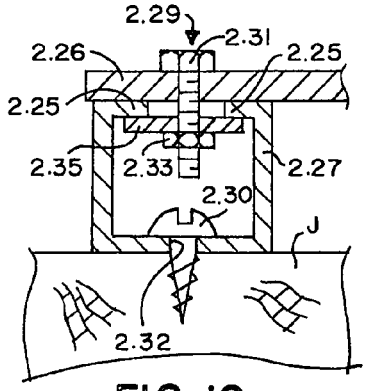
FIG. 19 is a sectional view of the base positioning means of the second embodiment, taken substantially along the lines 19-19 shown in FIG. 11.

Referring to FIGS. 12, 15, and 16, canopy junction box 2.56 is seen to preferably comprise a canopy cover 2.76, canopy junction box cover plate 2.78, and first and second threaded sleeves 2.80 and 2.79, respectively. In the preferred second embodiment, cover plate 2.78 has a metal bar 2.81 affixed, as by rivets 2.83, to the underside thereof. Metal bar 2.81 has a threaded hole 2.87, in alignment with hole 2.85 through cover plate 2.78, for receipt of threaded sleeve 2.79, and sleeve 2.79 is secured to cover plate 2.78 by threaded hole 2.87 and hex nut 2.82 in a manner that will now be apparent. First threaded sleeve 2.80 is secured to second threaded sleeve 2.79 by an adaptor (or "fixture hickey") 2.89, substantially spherical in shape, having upper and lower threaded holes 2.156 and 2.158, respectively, for receipt of threaded sleeves 2.79 and 2.80. Threaded sleeve 2.80 passes through hole 2.84 in canopy cover 2.76 and is then secured to canopy cover 2.76 by threaded hanger 2.86, which supports lighting fixture L, partially shown. Cover plate 2.78, constructed of a suitably strong non-conductor material and preferably fabricated as a well-known "printed circuit" board, has a second set of contacts, preferably concentric rings 2.88 shown in FIG. 15, laminated to the upper surface thereof as shown, mounted for receipt of electricity from the first set of contacts 2.68 when the light fixture is in the raised position, adjacent the ceiling. Together, the first set and second set of contacts, 2.68 and 2.88, are seen to comprise contact means for supplying electrical power to the light fixture when the light fixture is in the raised position. The circular symmetry of contacts 2.88 will be understood to allow proper contact between contacts 2.68 and 2.88 for any rotational orientation of canopy junction box 2.56 with respect to ceiling junction box 2.52. Wires 2.92 attach to contacts 2.88 preferably by means of slide-on fasteners 2.95 which connect to terminals or clips 2.94 which are riveted to contacts 2.88 by rivets 2.91. Wires 2.92 also pass through holes 2.98 in adaptor 2.89 and through a hole, not shown, in threaded hanger 2.86, and attach to lamps, not shown, in light fixture L, in the usual manner. It shall be understood that, alternatively, adaptor 2.89 could be omitted, causing threaded sleeve 2.80 to include sleeve 2.79, and having holes drilled therethrough for wires 2.92 as in the first embodiment. If desired, a grounding terminal 2.97 may be riveted to metal bar 2.81 using one of rivets 2.83, for connection to lamp fixture L in a manner well known to those skilled in the art.

In the preferred second embodiment, shown in FIG. 12, means are provided, such as peripheral edge 2.100 of canopy cover 2.76, extending toward ceiling surface S, for covering contact means, such as first and second set of contacts 2.68 and 2.88, from substantial access when the light fixture is in the raised position as shown in FIG. 12, as now will be understood by those skilled in the art.

Referring to FIG. 12, ceiling junction box 2.52 may additionally comprise limit switch means, preferably such as normally closed plunger type switches 2.102, interconnected with power control means 2.160 in a manner hereinafter described, so as to remove power from light fixture L when canopy junction box is not in the raised position, and also in a manner so as to remove power from motor 2.34 as canopy junction box 2.56 enters the raised position, thereby preventing canopy junction box from being hoisted past the raised position. Plunger switches 2.102, attached to ceiling junction box body 2.58 by nuts 2.101, are positioned with actuating plungers 2.104 extending downwardly for contact with actuating plate 2.105, shown in FIGS. 11 and 12. Actuating plate 2.105, shown in FIG. 17 and preferably constructed of a rigid insulating material such as synthetic plastic resin sold under the trademark PLEXIGLAS, has a hole 2.107 in the center thereof for the passage therethrough of cable 2.24, allowing plate 2.105 to freely move up and down relative to cable 2.24. Hole 2.107, while larger than cable 2.24, is smaller than the outer diameter of threaded sleeve 2.79. It will now be apparent that plate 2.105 is urged upwardly by sleeve 2.79 as the light fixture L enters the raised position adjacent the ceiling, see FIG. 12. As actuating plate 2.105 is urged upwardly by threaded sleeve 2.79, plate 2.105 contacts plungers 2.104, thereby opening limit switches 2.102 which appropriately control power to lighting fixture L and motor 2.34 in a manner hereinafter described. Although only one of switches 2.102 is required, as the two switches 2.102 are wired in series and are actuated substantially together, two are preferably provided for balanced and symmetrical contacting actuation with plate 2.105 and for safety in case one switch seizes in the closed position. Conversely, as light fixture L leaves the raised position, the flow of electricity from the source of electrical power to first set of contacts 2.68 is interrupted, in a manner hereinafter described, as plunger switches 2.102 assume the normally closed condition when plungers 2.104 are allowed to proceed downwardly when threaded sleeve 2.79 stops urging plate 2.105 upward against plungers 2.104. In this manner, when light fixture L is not in the raised position, and contacts 2.68 are exposed for access, electrical power is removed from contacts 2.68, in a manner hereinafter described, providing greater safety to a maintenance worker. Obviously, other appropriate safety and limit switch means could be equivalently provided to remove power from contacts 2.68 when they are exposed for access, in a manner that will now be apparent to those skilled in the art.

Referring to FIGS. 12 and 15, hoist cable 2.24 is seen to allow raising and lowering of light fixture L, preferably by attachment to canopy junction box 2.56 using attachment means such as anchor or ferrule 2.108 secured to threaded sleeve 2.79 by securing means such as a press-fit pin 2.110 inserted through hole 2.114 drilled transversely through threaded sleeve 2.79 and ferrule 2.108. Hoist cable 2.24 is securely fastened to anchor 2.108 by means well known to those skilled in the art, such as by being crimped or welded within a portion of anchor 2.108.

Hoist cable 2.24 and anchor 2.108 are seen to pass through hole 2.118 of ceiling junction box cover plate 2.60, with hoist cable 2.24 continuing to pass through hole 2.107 in actuating plate 2.105, then through tube 2.57 and through base 2.26. Cable 2.24 then passes over cable guide 2.122, preferably a pulley as shown, and on to take-up shaft 2.46 of hoist mechanism 2.22, where it is secured for winding into windings 2.124 on winch means 2.45. Referring to FIGS. 10 and 12, pulley 2.122, preferably attached to base 2.26 using means well known to those skilled in the art, such as screws 2.125, nuts 2.121, and standoffs 2.127, guides cable 2.24 emerging from the upper end of tube 2.57 onto take-up shaft 2.46. Standoffs 2.127 provide clearance between pulley housing 2.123 and base 2.26 for conduit connector 2.150. As hoist cable 2.24 winds and unwinds on take-up shaft 2.46, light fixture L is raised and lowered, traveling from a raised position adjacent ceiling C, as shown in FIG. 12, to a lowered position, not shown, distant from the ceiling, for cleaning, maintenance, and changing of bulbs.

Figure 20:
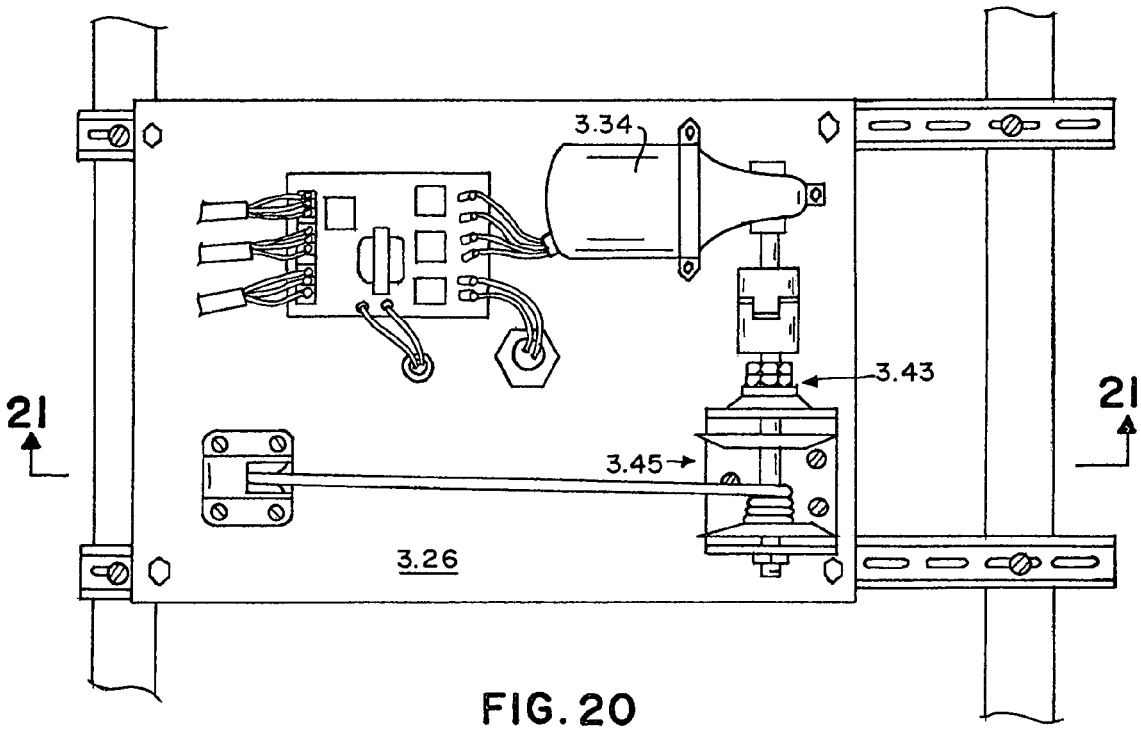
FIG. 20 is a top plan view of the third embodiment of the present invention, shown mounted on top of a pair of ceiling joists.
Figure 21:
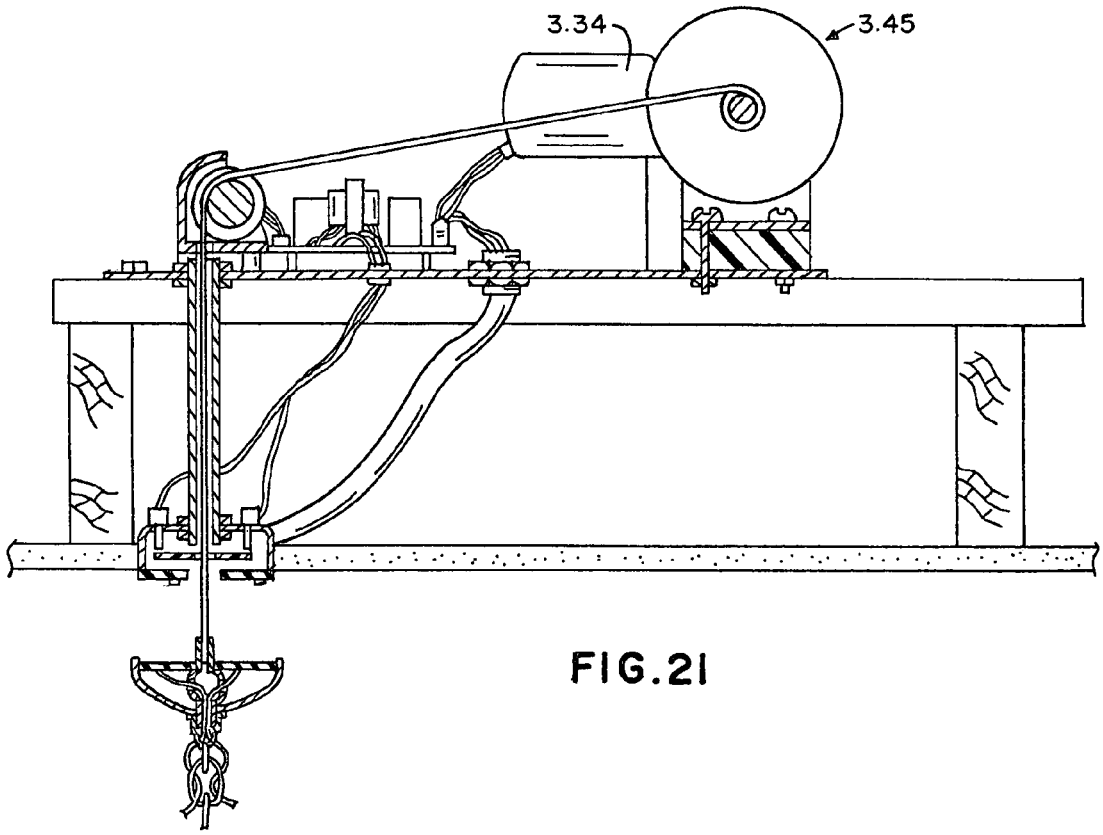
FIG. 21 is a front sectional view of the third embodiment, taken substantially along the lines 21-21 shown in FIG. 20.

FIGS. 20 and 21 show the third preferred embodiment, substantially similar to the second embodiment, and with identifying reference designators marked similarly to the second embodiment, except with the prefix "3.". The operation and all parts are similar to the second embodiment except that winch means 3.45, rather than having gear means as in the second embodiment (see 2.47 in FIG. 10), instead is a direct drive winch means, still with braking means 3.43 similar to that described in the second embodiment. A suitable winch means for this purpose is the Model K650 winch, manufactured by Fulton Performance Products, P.O. Box 19903, Milwaukee, Wis. 53219. Again, it will be noted that, by rearrangement of parts, a motor without a right-angle drive shaft (i.e., one with an output shaft as in the first preferred embodiment) could be used, with an appropriate sacrifice of the density of the items on base 3.26.

A fourth embodiment is similar to the second and third embodiments, but instead omits braking means 3.43 from winch means 3.45, and uses a motor 3.34 with self-contained braking means. A suitable motor for this purpose is the Model V80320AA33 gearmotor with optional brake, manufactured by the Von Weis Gear Company, St. Louis, Mo. A suitable winch means for this purpose may be made by The Chantland Company, P. O. DrawerA, Humboldt, Iowa 50548.

Figure 22:
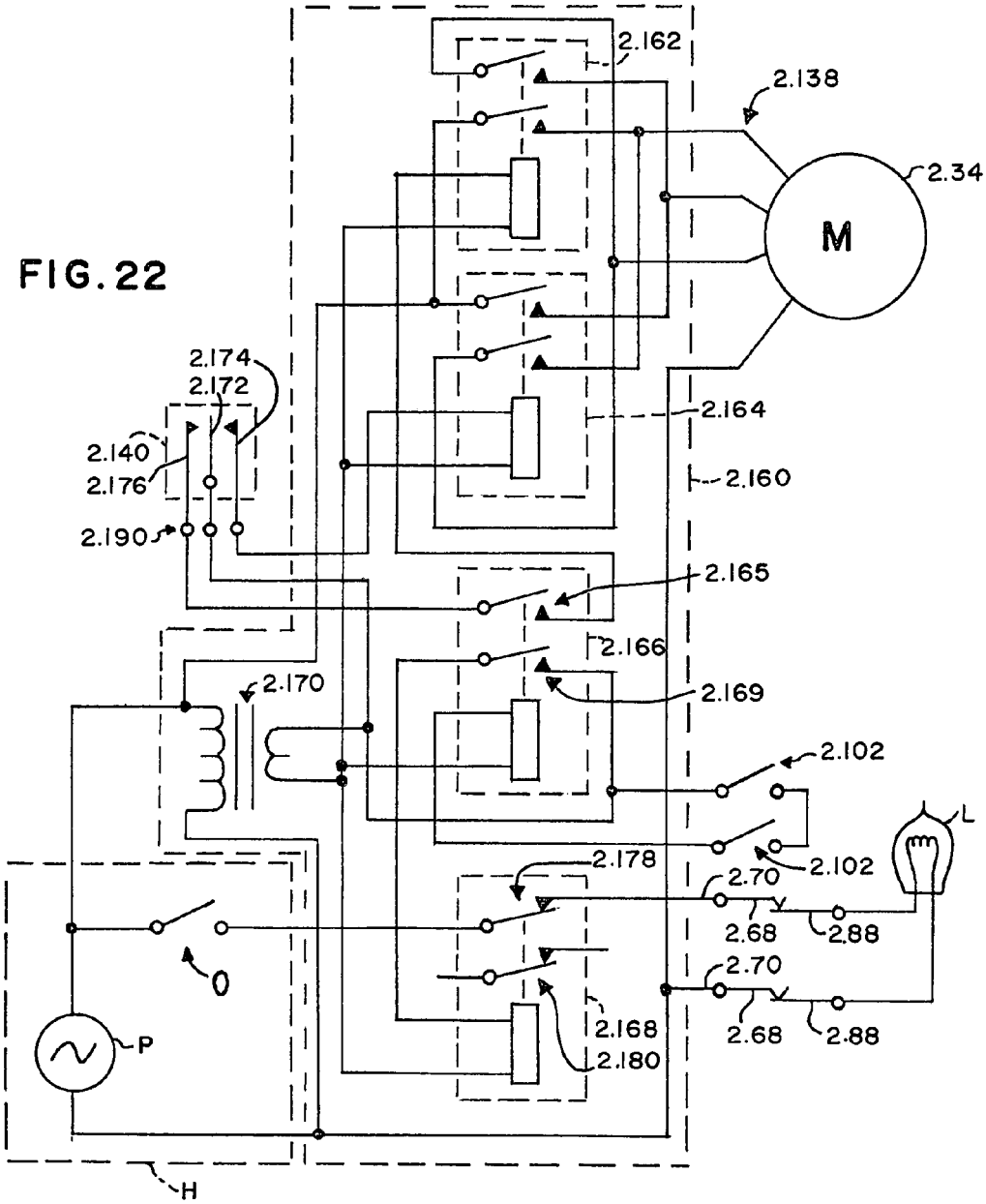
FIG. 22 is a schematic diagram showing the wiring interconnections for the second, third, and fourth embodiments.

Referring now to FIG. 22, the details of the preferred wiring interconnection for the second, third, and fourth embodiments are shown. The standard house wiring H, comprising a power source P, typically a 110 Volt AC power source, and an on-off switch O, supplies electrical power to power control means 2.160. Power control means 2.160 comprises first switching means, such as normally-open "UP" relay 2.162, normally open "DOWN" relay 2.164, and first set of normally-open contacts 2.165 of limit relay 2.166, for applying power to and reversibly controlling motor 2.34, as well as second switching means, such as normally-closed lamp power relay 2.168 and second set of normally-open contacts 2.169 of limit relay 2.166, for applying power to and removing power from light fixture L. It should be noted that relays 2.162, 2.164, 2.166, and 2.168 all preferably have coil energizing voltages of 24 Volts AC, being driven by step-down transformer 2.170, well known to those skilled in the art, having a primary winding voltage of 110 Volts AC, selected for compatibility with power source P, and having a secondary winding voltage of 24 Volts AC, selected for compatibility with the coil energizing voltages of relays 2.162, 2.164, 2.166, and 2.168.

When wall switch 2.140, similar to wall switch 140 previously described, is in the center or "OFF" position, neither of relays 2.162 or 2.164 are energized. When switch 2.140 is thrown in the "DOWN" position, contacts 2.172 and 2.174 are connected to each other, thereby energizing "DOWN" relay 2.164 (but not "UP" relay 2.162), applying power to the windings of motor 2.34 and causing it to turn in one direction in a manner well known to those skilled in the art.

When light fixture L is not in the raised position, i.e., lowered a distance from the ceiling surface S, normally-closed limit switches 2.102 are both closed because actuating plate 2.105 is not causing switches 2.102 to be actuated, as previously described. This closing of switches 2.102 energizes limit relay 2.166, closing contacts 2.165 and 2.169. When contacts 2.169 are closed, lamp power relay 2.168 is energized, opening first and second set of normally-closed contacts 2.178 and 2.180, respectively, on relay 2.168, thereby removing power from contacts 2.68, thereby providing safety for a maintenance worker who might accidentally come in contact with them.

In contrast, when light fixture L is in the raised position, switches 2.102 are opened by plate 2.105, causing limit relay 2.166 to not be energized, opening contacts 2.165 and 2.169. When contacts 2.165 are opened, the throwing of switch 2.140 in the "UP" position, connecting contacts 2.172 and 2.176 to each other, has no effect, as open contacts 2.165 prevent "UP" relay 2.162 from being energized, thereby preventing the light fixture from being hoisted past the raised position adjacent the ceiling surface S. Similarly, when contacts 2.169 are opened, again, only happening when light fixture L is in the raised position, lamp power relay 2.168 is caused not to be energized, closing normally-open contacts 2.178 and 2.180, thereby applying power to contacts 2.68, rings 2.88, and light L.

Now, when wall switch 2.140 is thrown in the "UP" position, causing contacts 2.172 and 2.176 to be connected to each other, if the light fixture L is not in the raised position so that contacts 2.165 are closed as previously described, "UP" relay 2.162 will be energized, applying power to motor 2.34 in a manner to cause the motor to rotate in a direction opposite that when "DOWN" relay 2.164 was energized, due to the permuted interconnection of the wires 2.138 to motor 2.34, as will be understood by those skilled in the art. When the light fixture L enters the raised position, adjacent the surface S of the ceiling C, switches 2.102 will become opened, applying power to the light fixture L through contacts 2.68, and removing power from motor 2.34 by de-energizing "UP" relay 2.162, in a manner previously described.

In practice, a maintenance worker would operate wall box key switch 2.140, causing motor 2.34 to lower light fixture L for maintenance. As light fixture L leaves the raised position, plunger switch 2.102 removes power from first set of contacts 2.68 as they become exposed for access, the light fixture descends further to a lowered position distant from the ceiling, allowing maintenance, and the key switch is returned to the "off" position. After maintenance is completed, key switch 2.140 is placed in the "up" position, causing motor 2.34 to raise light fixture L toward the ceiling. As light fixture L enters the raised position, switch 2.102 is actuated, restoring power to first set of contacts 2.68, restoring electricity to light fixture L. Also, as light fixture L enters the raised position, power is interrupted to drive motor 2.34, preventing light fixture L from being raised past the raised position adjacent the ceiling. Light fixture L will remain in the raised position until key switch 2.140 is again turned to the "down" position, repeating the lowering process.

As a variation on these prior art hoists, a third pair of contacts 2.68 and 2.88 could be provided on cover plates 2.60 and 2.78, respectively, connected through presently unused contacts 2.180 on relay 2.168 to another on-off switch, not shown, in house wiring H, for operating another electrical device on light fixture L such as a second light or a ceiling fan.

Figure 23:
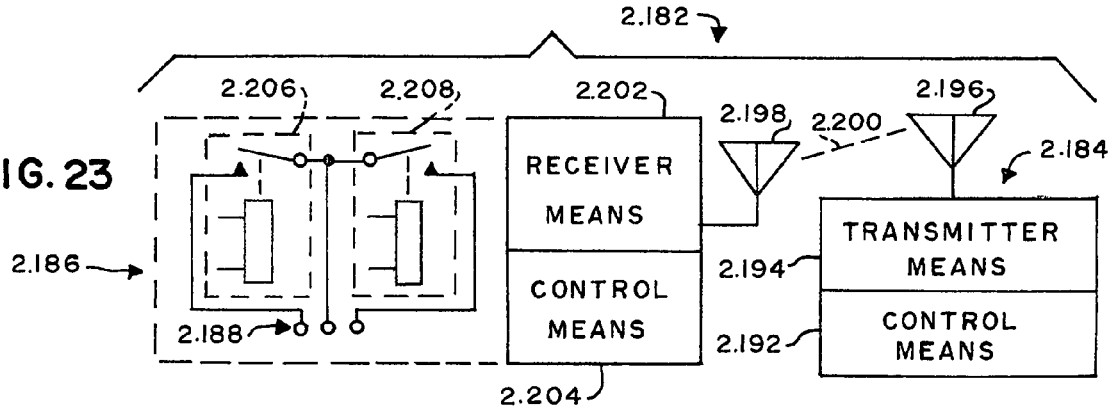
FIG. 23 is a diagram showing the wireless remote control means of the present invention.

If desired, for any of the embodiments, a wireless remote control means, preferably such as shown in FIG. 23, may be used in place of wall box key switch 2.140. Remote control means 2.182, well known to those skilled in the art, comprises a transmitter portion 2.184 and a receiver portion 2.186, with receiver portion preferably mounted on base 2.26 and connected, at terminals 2.188, in place of wall box key switch 2.140 at terminals 2.190. Transmitter portion 2.184 comprises transmitter control means 2.192, well-known to those skilled in the art, with an "UP" button and a "DOWN" button, not shown, for causing transmitter means 2.194 to transmit a certain radio signal 2.200 from antenna 2.196 to antenna 2.198 of receiver portion 2.186. Receiver portion 2.186 receives the radio signal 2.200 using receiver means 2.202, well-known to those skilled in the art, and causes receiver control means 2.204, responsive to receiver means 2.202, to actuate switching means 2.206 or 2.208, alternately, depending on whether the "UP" or "DOWN" button was pressed on transmitter control means 2.192, in a manner well-known to those skilled in the art. It will now be understood that, acting together, switching means 2.206 and 2.208 perform the same function as did contacts 2.176, 2.172, and 2.174 of wall switch 2.140. It also be understood that, rather than employing a radio signal 2.200 to convey the desired "UP" or "DOWN" movement of light fixture L, an infrared transmitter and receiver, well known to those skilled in the art, could be used instead, passing an infrared signal between the transmitter and the receiver. In such a case, as is well known to those skilled in the art, an infrared transmitting means would replace transmitting antenna 2.196 and transmitting means 2.194, while an infrared detector and receiving means would replace receiving antenna 2.198 and radio receiver means 2.202. Obviously, in such a variation of these prior art hoists, it would be necessary to place the infrared detector on a surface of the room in which the infrared transmitter would be used.

Now that exemplary prior art hoists have been described in detail, the improvement of the present invention can be described. Referring to FIGS. 24-28, the improved hoist 500 of the present invention, like prior art hoists including the prior art chandelier hoists heretofore described, includes a winch 504 that includes a take-up shaft 506 upon which hoist cable 502 is wound and unwound, and winch 504 further includes reversible motor means 508 operably coupled to take-up shaft 506. It should be understood that hoist cable 502 is preferably similar to hoist cables 24 and 2.24 heretofore described, that take-up shaft 506 is preferably similar to take-up shafts 46 and 2.46 heretofore described, and that motor means 508 is preferably operably coupled to take-up shaft 506 as by gear means such as prior art gear means 2.47 heretofore described and driving winch gear 510 or by a coupling such as coupling 44 heretofore described. Reversible motor means 508 is provided for turning take-up shaft 506 in a raising direction 512 in which hoist cable 502 is wound upon take-up shaft 506 in a first winding direction 514, and for turning take-up shaft 506 in a lowering direction 516 in which hoist cable 502 is unwound from the take-up shaft.

Hoist 500 further includes a well-known up-down switch 518, which may be similar to well-known keyswitch 140 or 2.140 heretofore described and likewise interconnected to a well-known motor control circuit 520 which is preferably similar to motor power control means 2.160 heretofore described, or switch 518 may be a well-known switch with interlocked pushbuttons. Switch 518 has an up mode, in which common contact 522 completes a circuit with up contact 524, thereby causing a source of power to be applied to motor means 508 so as to cause take-up shaft 506 to turn in the raising direction 512. Switch 518 also has a down mode, in which common contact 522 completes a circuit with down contact 526, thereby causing the source of power to be applied to motor means 508 to cause take-up shaft 506 to turn in the lowering direction 516. Switch 518 further has an inactive mode (shown in FIG. 25), in which common contract 522 does not complete a circuit with either up contact 524 or down contact 526, such that the source of power is not applied to motor means 508.

The improvement of the present invention comprises safety switch 528 in series with up-down switch 518, preferably as by being a normally-closed switch interposed in series between common contact 522 and motor control circuit 520, such that, when safety switch 528 is actuated, in a manner hereinafter described, the source of power cannot be applied to motor means 508 by up-down switch 518 through motor control circuit 520.

Figure 26:
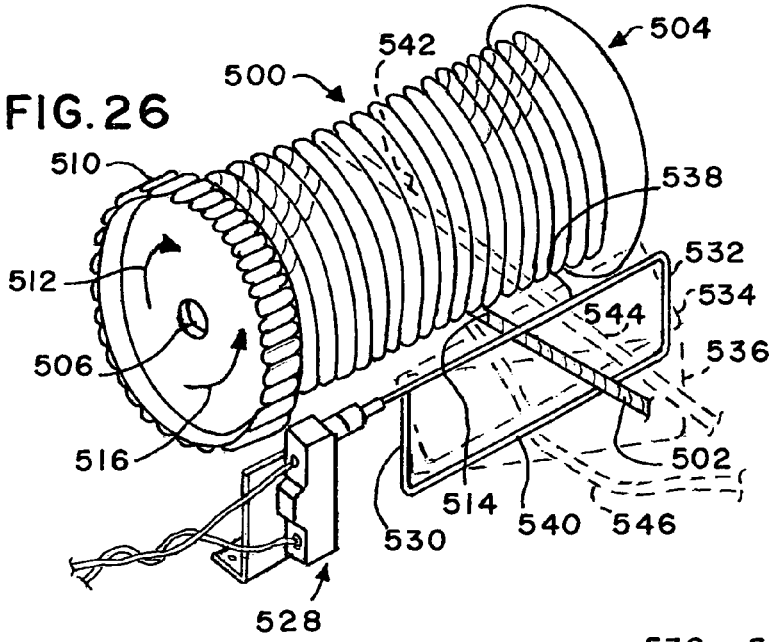
FIG. 26 is a perspective view of a winch of the present invention, showing operation of the safety switch.
Figure 27:
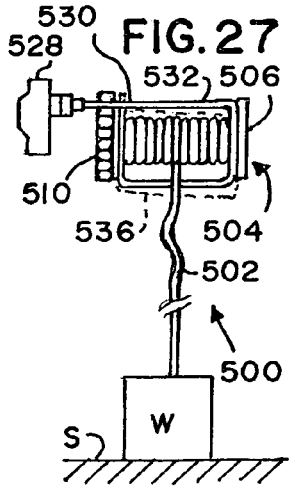
FIG. 27 is a diagrammatic view of the present invention with the winch shown hoisting a weighted object.
Figure 28:
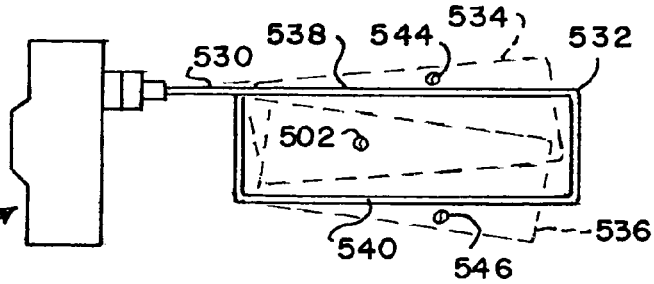
FIG. 28 is a front elevation view showing actuation of the safety switch of the present invention.

Safety switch 528 includes an actuating member 530 extending from safety switch 528 and proximate take-up shaft 506 for actuating safety switch 528 when actuating member 530 is moved from an un-actuated position 532 (shown in solid outline in FIGS. 26-28) to one of a plurality of actuated positions 534, 536 (shown in dotted outline in FIGS. 26-28).

Actuating member 530 has first and second spaced-apart portions 538, 540 with hoist cable 502 being intermediate first and second spaced-apart portions 538, 540 of actuating member 530, and safety switch 528 is mounted such that, when weighted object W is supported by hoist cable 502 and hoist cable 502 is wound upon take-up shaft 506 in the first winding direction 514, actuating member 530 is in the un-actuated position 532 and neither of said first or said second spaced-apart portions 538, 540 of actuating member 530 is caused to be moved by hoist cable 502 from the un-actuated position.

Safety switch 528 is also mounted such that, when hoist cable 502 is wound upon take-up shaft 506 in a second winding direction 542 (shown in dotted outline in FIG. 26), reversed from the first winding direction 514, at least one of the first and second spaced-apart portions 538, 540 of actuating member 530 is caused to be moved by hoist cable 502 such that actuating member 530 is moved thereby into one of the plurality of actuated positions 534 or 536. In the preferred embodiment, actuating member 530 is formed as a closed rectangular loop surrounding hoist cable 502, and first and second spaced-apart portions 538, 540 are upper and lower portions of the closed loop, with hoist cable 502 causing actuating member 530 to be moved as hoist cable 502 moves from its normal position within and not contacting the closed loop, into abnormal positions 544 or 546 (see FIG. 28) where cable 502 contacts first and second spaced-apart portions 538, 540 of actuating member 530 and thereby moves actuating member 530 from its un-actuated position 532 into one of its actuated positions 534 or 536. It shall be understood that, while FIG. 26 shows the first winding direction 514 of hoist cable 502 with hoist cable 502 passing under take-up shaft 506 as it is wound thereupon, and with second winding direction 542 with hoist cable 502 passing over the top of take-up shaft 506, first and second winding directions 514, 542 could be interchanged, if desired, if the raising and lowering directions 512 and 516 were interchanged and if the mounting of safety switch 528 were moved appropriately so that hoist cable 502 does not move actuating member 530 from the un-actuated position when the hoist cable 502 is weighted by supporting the weighted object W with the hoist cable 502 being wound upon the take-up shaft 506 in what would then be the first winding direction.

Safety switch 528 is further mounted such that, when weighted object W is not supported by hoist cable 502 (see, for example, FIG. 27, in which weighted object W rests upon a surface S, such as a floor), at least one of the first and second spaced-apart portions 538, 540 of actuating member 530 is caused to be moved by hoist cable 502 such that the actuating member 530 is moved thereby into one of the plurality of actuated positions 544 or 546. It shall be understood that, when weighted object W is not supported by hoist cable 502, hoist cable 502 becomes slack and enters abnormal position 546 or 544, thereby moving the actuating member 530 from its un-actuated position 532.

Actuating member 530 is seen to preferably be an elongated rectangular loop so that, as hoist cable 502 is wound side-to-side upon take-up shaft 506, the hoist cable 502 does not contact the loop of the actuating member. Furthermore, the spacing apart of first and second spaced-apart portions 538, 540 of actuating member 530 is selected so that, during normal winding of hoist cable 502 upon take-up shaft 506, the actuating member 530 is not contacted by hoist cable 502. However, when the hoist cable becomes unweighted, or when the hoist cable becomes wound on the take-up shaft 506 in the second winding direction, as may happen when an inattentive operator continues to operate the winch in the lowering direction past the point where the hoist cable is fully unwound and then begins to wind upon take-up shaft 506 in the second winding direction, the actuating member 530 becomes moved and thereby actuates safety switch 528, thereby stopping the motor and preventing injury to a person below the hoist and preventing damage to the hoist and its supporting structures if the weighting object were to continue to move upward while the motor is operated in what should be the lowering direction.

Figure 24:
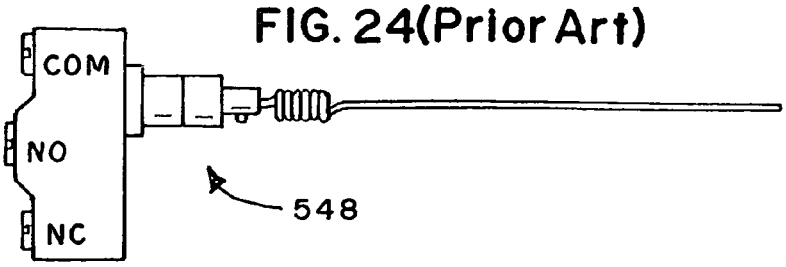
FIG. 24(Prior Art)
FIG. 24 is a view of a prior art "whisker switch" as may be used with the preferred embodiment of the present invention.
Figure 25:
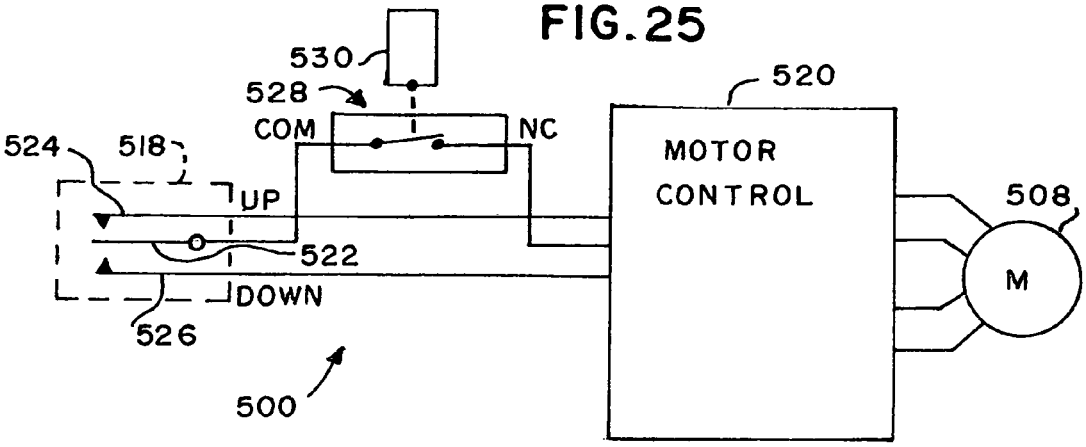
FIG. 25 is a schematic diagram of the preferred embodiment of the present invention.

In the preferred embodiment of safety switch 528, a well-known prior art normally-closed switch, such as a so-called "whisker" switch 548 shown in FIG. 24, is modified to have the "whisker" replaced by the actuating member 530 of the present invention, such that, when the actuating member 530 is moved by the hoist cable 502, the safety switch will open and power will be removed from up-down switch 518, thereby disabling operation of the motor 508. A suitable such switch is the general-purpose whisker switch model Z-15HNJS55-B manufactured and sold by OMRON Corporation, a/k/a/ OMRON Izumo Co., Ltd., of Japan. which has a sales office at 55 East Commerce Drive, Suit B, Illinois, 60173 U.S.A.

The present invention disables operation of motor 508 when either the unweighted condition or the reversed winding direction condition occurs so that intervention and inspection by a technician is required, thereby ensuring that a safety inspection can be made of the hoist before re-enabling its operation. It has been found that some homeowners or installers disable or bypass the fuse for the motor, thereby preventing blowing of a safety fuse and creating a hazardous condition. The present invention, being designed to ensure safety, allows a safety inspection to occur prior to re-enabling operation of the hoist.

During installation of the hoist, or following a safety inspection, temporary clip leads may be used to short across the terminals of switch 528, completing the circuit through switch 528, and allowing the motor to operate for testing even if actuating member 530 is moved. Once the hoist cable 502 is again properly wound upon take-up shaft 506 and proper operation of the hoist has been verified, then the temporary clip leads may be removed and the safety switch 528 can resume its protective function.

Although the present invention has been described and illustrated with respect to a preferred embodiment and a preferred use therefor, it is not to be so limited since modifications and changes can be made therein which are within the full intended scope of the invention.

I claim:

1. An improved hoist for raising and lowering a weighted object secured to a hoist cable, the hoist including:

(a) a winch, the winch including:

i. a take-up shaft upon which the hoist cable is wound and unwound; and ii. reversible motor means operably coupled to the take-up shaft for turning the take-up shaft in a raising direction in which the hoist cable is wound upon the take-up shaft in a first winding direction, and for turning the take-up shaft in a lowering direction in which the hoist cable is unwound from the take-up shaft; and (b) an up-down switch, the up-down switch having:

i. a up mode in which a source of power is caused to be applied to the motor means to cause the take-up shaft to turn in the raising direction;

ii. a down mode in which the source of power is caused to be applied to the motor means to cause the take-up shaft to turn in the lowering direction; and iii. an inactive mode in which the source of power is caused not to be applied to the motor means;

wherein the improvement comprises: a safety switch in series with the up-down switch such that, when said safety switch is actuated, the source of power cannot be applied to the motor means by the up-down switch; said safety switch including an actuating member extending therefrom and proximate said take-up shaft for actuating said safety switch when said actuating member is moved from an un-actuated position to one of a plurality of actuated positions; said actuating member having first and second spaced-apart portions with said hoist cable being intermediate said first and second spaced-apart portions of said actuating member; said safety switch being mounted such that:

A. when the weighted object is supported by the hoist cable and the hoist cable is wound upon the take-up shaft in the first winding direction, said actuating member is in said un-actuated position and neither of said first or said second spaced-apart portions of said actuating member is caused to be moved by the hoist cable;

B. when the hoist cable is wound upon the take-up shaft in a second winding direction reversed from said first winding direction, at least one of said first and second spaced-apart portions of said actuating member is caused to be moved by the hoist cable such that said actuating member is moved thereby into one of said plurality of actuated positions; and C. when the weighted object is not supported by the hoist cable, at least one of said first and second spaced-apart portions of said actuating member is caused to be moved by the hoist cable such that said actuating member is moved thereby into one of said plurality of actuated positions.

2. The improved hoist as recited in claim 1, in which said actuating member is formed as a closed loop surrounding the hoist cable.

3. The improved hoist as recited in claim 2, in which said first and second spaced-apart portions are spaced-apart portions of said closed loop.

4. The improved hoist as recited in claim 1, in which said actuating member is formed as a closed loop surrounding the hoist cable, and the hoist cable causes said actuating member to be moved by contacting one of said first and second spaced-apart portions of said actuating member.

* * * * *